US007992325B2

(12) United States Patent
Walworth et al.

(10) Patent No.: US 7,992,325 B2
(45) Date of Patent: Aug. 9, 2011

(54) FLEXIBLY RIGID PERSONAL PROTECTIVE EQUIPMENT COMPONENTS

(75) Inventors: Van T. Walworth, Lebanon, TN (US); David B. Hook, Franklin, TN (US); Thomas Leonard, Geneva, OH (US); Craig Whitaker, Fairfield, OH (US); James F. Walworth, Manhattan, KS (US); Brian Church, Franklin, TN (US); Dave Goldman, Towaco, NJ (US); Mark Howell, Lebanon, TN (US)

(73) Assignee: Shew, Inc., Brentwood, TN (US)

( * ) Notice: Subject to any disclaimer, the term of this patent is extended or adjusted under 35 U.S.C. 154(b) by 936 days.

(21) Appl. No.: 11/935,122

(22) Filed: Nov. 5, 2007

(65) Prior Publication Data

US 2008/0115387 A1 May 22, 2008

Related U.S. Application Data

(60) Provisional application No. 60/856,927, filed on Nov. 6, 2006, provisional application No. 60/932,272, filed on May 30, 2007.

(51) Int. Cl.
*A43B 13/14* (2006.01)
*A43B 23/00* (2006.01)

(52) U.S. Cl. ..... 36/72 R; 36/77 R; 36/73; 36/54

(58) Field of Classification Search ..... 36/72 R, 36/77 R, 73, 54, 107, 57–58

See application file for complete search history.

(56) References Cited

U.S. PATENT DOCUMENTS

| | | | | | |
|---|---|---|---|---|---|
| 2,091,223 | A * | 8/1937 | Binder | 36/72 R |
| 3,950,865 | A * | 4/1976 | Gray | 36/77 R |
| 4,231,170 | A * | 11/1980 | Griswold | 36/72 R |
| 4,439,937 | A * | 4/1984 | Daswick | 36/107 |
| 4,779,361 | A * | 10/1988 | Kinsaul | 36/102 |
| 4,888,888 | A * | 12/1989 | Ashton | 36/43 |
| 4,908,963 | A * | 3/1990 | Krajcir et al. | 36/77 R |
| 5,606,808 | A * | 3/1997 | Gilliard et al. | 36/89 |
| 5,711,092 | A * | 1/1998 | Despres et al. | 36/72 R |
| 5,979,081 | A * | 11/1999 | Vaz | 36/107 |
| 6,167,639 | B1 * | 1/2001 | Ventura | 36/44 |
| 6,178,664 | B1 * | 1/2001 | Yant et al. | 36/44 |
| 6,381,876 | B2 * | 5/2002 | Krajcir | 36/72 R |
| 7,305,776 | B2 * | 12/2007 | Hess | 36/72 R |

* cited by examiner

*Primary Examiner* — Ted Kavanaugh
(74) *Attorney, Agent, or Firm* — Harness, Dickey & Pierce, PLC

(57) ABSTRACT

The subject invention improves traditional safety equipment intended to protect the lower leg, ankle, foot, and toes applicable in industrial and commercial as well as casual and athletic uses. The personal protective equipment (PPE) of the subject invention comprises a soleplate, a metatarsal component, a toe cap, and a tibia-fibula component; these components can be implemented alone or in combination within a shoe or boot providing for various levels of protection depending on the desired application. Further embodiments provide for both the implementation of the protective components within the footwear as well as components that can be worn in conjunction with pre-existing shoes or boots.

25 Claims, 8 Drawing Sheets

FLEXIBLY RIGID PERSONAL PROTECTIVE EQUIPMENT COMPONENTS

CROSS-REFERENCE TO RELATED APPLICATIONS

Figure 1A:
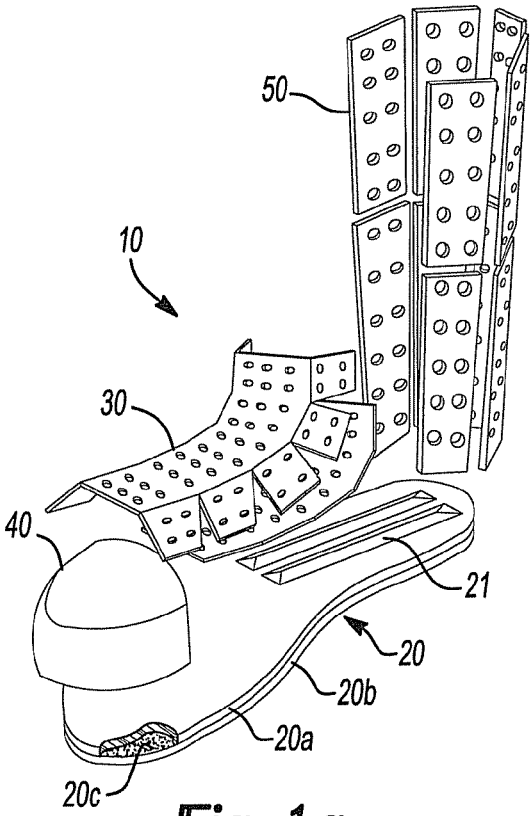

This application claims the benefit of U.S. Provisional Application Ser. No. 60/856,927, filed Nov. 6, 2006, and U.S. Provisional Application Ser. No. 60/932,272, filed May 30, 2007. The disclosures of the above applications are incorporated herein by reference.

FIELD

This present disclosure relates to protective equipment for personal use. More particularly, the present disclosure relates to protective equipment pertaining to the lower leg, ankle, and foot implemented with personal athletic and commercial footwear.

BACKGROUND

There are many applications of personal protective equipment (PPE) components embedded into the fabrication of various shoes, boots, protective guards, aprons, sheathing, vests, helmets, gloves, and many other devices. Each of the above applications has many specific applications in the marketplace. For example, work boots may have a safety toe and/or a metatarsal shield and/or a puncture-resistant sole and/or embed various devices to minimize shock hazards, etc.

Each specific application has further applications based on the type of materials used to construct the PPE components in the various applications in which they are employed. Some common PPE materials include metal, plastic, polymers, rubber, fiberglass, wood, and/or various composites. In addition, materials such as Kevlar and similar variants provide levels of protection against ballistic penetration.

A specific application of a work boot is further expanded by identifying that there are many varied applications of the boot, such as manufacturing, heavy industrial, combat boots, jump boots, hiking, fireman, muck boots, linemen, static dissipative, shockproof, construction, snakebite, and many other specific applications. Each of these applications requires a different set of PPE components to address the needs of the user.

In addition to boots, PPE components are sometimes employed into casual shoes, sports shoes, and other types of footwear. It is improbable for one foot application to employ every version of PPE available, rather that different footwear applications employ appropriate PPE components to meet the need of the user.

In addition to footwear applications, there are applications for PPE related to gloves, aprons, strap-on devices, vest, shields, helmets, and many other PPE products. Each application implements a unique set of PPE components to provide the user with a measure of protection.

The disadvantages of current methods are numerous. One disadvantage is that many PPE component applications are bulky, heavy, or cumbersome, causing discomfort to the user. This discomfort results in reduced satisfaction on the part of the user and often results in the user not wearing the PPE safety device.

Another disadvantage is that current methods do not provide a ventilation means and/or they provide little or no insulation potential.

Another disadvantage of the current methods is that the PPE components require very rigid structures that correspondingly restrict movement by the user and promote discomfort. For example, work boots that employ puncture-resistant soles employ PPE components that provide a puncture-resistant device that does not promote flexibility along the arch portion of the foot. In similar fashion, PPE components that provide a rigid shank device do not promote flexibility for the rest of the foot.

Another disadvantage of the current methods is that there is no safety toe cap designed to provide protection from lateral crushing forces. For example, all current safety toe caps are designed to resist a certain amount of vertical impact and vertical crushing forces, but not one toe cap is designed to resist similar lateral impact or lateral crushing forces.

A further disadvantage of the current methods is that a measure of safety must be reduced in order to achieve flexibility in certain PPE components. Also, the conflict between flexible PPE components and rigid PPE components results in the employment of multiple PPE components in the product application, which inflates the costs of the final product and/or complicates the manufacture of the product application, also inflating final production costs.

Yet another disadvantage of the current methods is that the materials used for many PPE components results in heavy structures that give the wearer an un-natural feel using the device. However, a reduction in weight of many PPE components results in reduced protection.

Another disadvantage of the current methods is that the expense of the PPE components limits the applications where they can be implemented. For example, Kevlar is a material with good ballistic penetration protection. It is also useful in puncture-resistant soles of work boots. However, the PPE component cost of Kevlar makes this material an unrealistic choice of construction material for most mainstream consumer products.

Yet another disadvantage of the current methods is that the PPE component materials do not lend themselves to alternate applications of the component. For example, steel safety toe components designed for heavy-duty applications do not have a light-duty version available for the mainstream market. As a result, light-duty applications seldom exist in the marketplace because there are little or no practical PPE components available for construction.

Still another disadvantage of the current methods is that there is no method of providing a structure that is inherently strong and yet lighter in weight compared to a similar structure using the same materials.

Yet another disadvantage of the current methods is that no viable safety toe cap designs are available that provide a non-bulbous low-profile toe cap that still provides performance requirements per ASTM or other similar standards. For example, there are no low-profile, non-bulbous toe caps that can be stylishly assembled into dress shoes or pointed cowboy boots that still provide acceptable performance per ASTM standards.

Yet another disadvantage of the current methods is that heavy-duty PPE components result in very cumbersome devices that interfere with the user's ability to function. For example, heavy-duty Kevlar vests protect the wearer from many life-threatening ballistic penetrations, but with the penalty of weight, lack of ventilation, and restricted movement. Another disadvantage of this current method is that these same PPE components have little or no known construction method for their application to combat footwear. Therefore, a solider may be well protected from upper body ballistic penetration and still be vulnerable to lower leg and foot injuries.

Still another disadvantage of the current methods is that many applications simply avoid employing PPE components because of thermal problems with either heat sinks and/or cold sinks. As a result, potential PPE advantages are not implemented, resulting in reduced protection for the user. For example, combat boots often do not contain a metal safety toe or metal puncture-resistant soleplate because of both the thermal problems associated with the metal as well as the problem of weight added to the boot. The combination of these disadvantages leads to basic issue combat and military boots not employing PPE components in the toe, metatarsal, sole, or anywhere else in the boot. The metallic PPE components in a combat boot potentially interfere with electrical components or communication signals, while non-metallic applications of the preferred embodiment prevent RFI and/or EMI problems.

Still another disadvantage of the current methods is that there are no viable application solutions for sports shoes that would prevent Turf Toe, an injury resulting from the toe of the foot being hyper-extended during sports activities.

Yet another disadvantage of the current methods is that they do not provide a viable relatively rigid soleplate section located directly at the end of the toes of climbing shoes that provides a suitable support for the toes of the foot when climbing in places with very slight toe holds.

Still another disadvantage of the current methods is that there are no viable application solutions for medical footwear that prevents impalement from dropped scalpels and needles or other sharp instruments during medical procedures.

Still another disadvantage of the current methods is that there is no viable method to determine by visual or tactile means whether PPE components have been compromised by an incidental impact incident. For instance, safety toe caps can be subjected to incidental impact forces that may or may not have cracked and/or may or may not have compromised the toe cap's ability to maintain appropriate safety performance ratings, and there is not a viable non-destructive means for the wearer to evaluate the toe cap to determine the integrity of the toe cap.

The disadvantages described above have similar scenarios in every product application where PPE components are employed using the current methods. While each application is different, the disadvantages follow similar themes of excessive cost, thermal problems, weight, and/or incompatibility of rigidity compared to flexibility.

A further embodiment of the present invention covers toe caps incorporated into personal footwear. Safety toe caps are required in many industries for many different reasons. Toe caps are designed to provide support protection from vertical crush forces. Additional performance requirements, such as electrical resistance, static resistance, chemical resistance, and the like, have led toe caps to the development of many construction materials other than steel.

Most workplace accidents that involve toe caps are the result of vertical crush forces. Safety caps are specified and required in many workplaces to provide personal protection for the wearer in the event that the foot is subjected to a vertical crush force.

However, a growing number of industry accidents occur each year related to lateral crush forces acting against the foot. Such accidents can take place when a worker gets his foot caught between rolling pipe, between pallets, or between pieces of equipment. In addition, a growing number of lateral side crush incidents take place each year related to truck loading and unloading, or in the construction industry where close quarters for foot placement exist.

Traditional safety toe caps are designed to meet specific performance requirements for vertical crush forces. If the same vertical crush force were to be applied to a traditional toe cap, the relative strength of the toe cap would only be about 20% of the vertical crush force loads.

The subject invention overcomes the stated problems of prior art toe caps and provides crush-resistant support against lateral crush forces. In addition, the subject invention provides improved structural performance against vertical crush forces.

The subject invention ushers in a new era of personal protective footwear that provides unprecedented protection from lateral side crush forces and will require that new standards be written and new test methods be established that embody the improved performance characteristics of this improved safety toe cap.

Prior art forms of safety toe caps for safety shoes are designed provide a measure of personal protection for the wearer in the event that a vertical crush force is subjected to the shoe. This protection provides a measure of protection to the toes and foot of the wearer against vertical crush forces. Many designs of toe caps exist in the global market place. Many construction materials are used to manufacture toe caps, such as steel, aluminum, plastics, fiberglass, composites, and other materials.

There are many different grades of vertical crush-resistant toe caps which are designed in compliance with various technical specifications. For instance, there are ASTM standards, Canadian standards, European standards, mining standards, military specifications, and others. It is seldom, if ever, practical for one toe cap design to meet all of the requirements of all the various technical standards in the industry.

All of the technical standards include testing provisions for vertical crush forces and appropriate minimum test requirements that must be met to comply with each respective standard. All safety toe caps used in the industry today are designed to comply with one of these standards or a similar performance requirement related to vertical crush forces.

While it is understood and recognized that the technical standards also provide design requirements for electrical features, impact, and chemical resistance, the focus of the subject invention is related directly to the vertical crush force applications and specifications of these technical standards.

Prior art safety toe caps all have a portion that covers over the toes of the foot and wraps around the sides of the foot at the toes. In addition, the prior art toe caps include a closed-toe portion at the front end of the toes. Some prior art toe caps include a portion that wraps further around the sides of the foot to form a flange-type structure extending laterally inward under the foot. The structural size and/or significance of the flange-type structure varies greatly from toe cap design to toe cap design, with many toe cap designs that have no evidence of the flange-type feature.

Typical steel, aluminum, or metal toe caps usually feature a uniform wall thickness everywhere in the cap, which is the most economical method for metal forming process. Some metal castings will feature different wall thicknesses in one portion of the toe compared to other wall thicknesses in other portions of the toe cap, which can provide improved strength in response to vertical crush forces.

Some prior art forms of toe caps include the placement of fibers in the toe cap walls to provide improved resistance to vertical crush forces. Other toe cap designs provide thick nose portions which are claimed to provide improved resistance to vertical crushing forces.

One problem with prior art forms of toe caps is that the current methods to improve the strength and performance of the toe cap against vertical crush forces result in the toe cap being bulky and bulbous, which makes the shoe undesirable to the wearer.

Another problem with prior art forms is that the extreme lateral sides of the toe cap spread out in a further lateral position relative to each other in response to vertical crushing force, resulting in severe deformation and/or damage to the shoe.

Another problem with prior art forms is that the extreme lateral sides of the toe cap are driven down into the shoe in response to vertical crush forces, resulting in reduced internal vertical space for the foot and toes.

Another problem with prior art forms is that none of the known toe caps are designed to provide support protection for the wearer against lateral crush forces. None of the technical standards provide a test procedure or a performance requirement against lateral side crush forces.

The subject invention overcomes these problems and provides additional improvements to safety toe caps that will be understood and appreciated by those skilled in the art.

SUMMARY

It is therefore an objective of the subject invention to provide PPE components that provide flexibility in portions of the product application that require flexibility while at the same time provide rigidity in portions of the product application that require rigidity. For example, the present invention applied to PPE components used as a puncture-resistant soleplate in a work boot requires flexibility in the front portion of the component while at the same time requiring a rigid portion of the same component in the shank area under the arch of the foot.

It is an objective of the subject invention to provide PPE components that are constructed of at least one layer. PPE components constructed from multiple layers use combinations of different materials to their advantage by creating structures with physical properties greater than the individual properties of any one layer. For example, a PPE puncture-resistant soleplate for a work boot made from solid metal is relatively heavy and relatively inflexible. However, a puncture-resistant soleplate with similar puncture-resistant performance characteristics and flexibility performance characteristics to that of solid metal can be achieved with the subject invention by constructing multiple layers of non-metal materials and/or sandwiching a thin metal layer between other non-metal layers.

It is an objection of the subject invention to provide PPE components for sports shoes that minimize and/or prevent Turf Toe injuries by introducing reinforced ribs and/or darts and/or flange structures into a soleplate under the toe portion of the foot and extending back toward the ball of the foot area of the soleplate. These reinforced structures may have alternate geometry construction that changes the shape of the rib as it transverses from the toe back toward the ball of the foot, including potentially tapering and/or feathering to a blend at, near, or just past the ball of the foot portion of the soleplate.

It is an objective of the subject invention to provide a ventilation means for PPE components, such as metatarsal devices, safety toes, Tib-Fib devices, mosaic structures, thumb and finger PPE, arm and leg PPE, and other body PPE devices. Ventilation features will enable increased comfort to the user. An alternative to the ventilation feature is to provide an insulation chamber within the PPE component structure.

It is an objective of the subject invention to take a layer of material, that is not suitable for the desired performance requirements on its own, and combine it with additional layers and/or with additional materials to establish a PPE component that exhibits performance results that exceed any material by itself. For example, the thin metal layer of a work boot soleplate may be flexible, but it does not provide appropriate puncture resistance until it is encapsulated between the layers of non-metal materials, resulting in a PPE component structure that is relatively lightweight and relatively flexible, while still providing the same or better puncture resistance as the solid metal layer of current methods. In the same way, a thin metal soleplate layer may be flexible, which will prevent it from providing shank support at the arch, until it is encapsulated between layered components of the subject invention.

It is another objective of the subject invention to take a single layer of material that is flexible in certain portions of the product application and modify the geometry of other portions with a single layer of the product application to provide a rigid structure. For example, a relatively thin metal soleplate applied to a work boot for puncture resistance must have a certain amount of flexibility for the foot to have a measure of comfort; however, that same flexibility does not promote a shank support. Therefore, the subject invention applied to the relatively thin metal soleplate applies darts and/or rib structures to the soleplate in the areas of the arch of the foot, providing shank support.

It is an objective of the subject invention to provide biaxial interlocks between juxtaposed layers so as to form geometric structures that provide rigid support in certain portions of the product application while at the same time providing interlocks, preventing relative rotation and/or slippage of the layers relative to each other. For example, multiple layers of a soleplate in a work boot might be manufactured from a relatively thin polycarbonate material to provide flexibility for the front of the foot, while darts and/or ribs are formed in the arch portion of the soleplate to provide rigid shank support. A first series of darts and/or ribs simultaneously provide shank support along with relative registration of the layers in one linear direction. Therefore, a second series of shank support darts and/or ribs are formed, interlocking the layers such that the second series is oriented relatively transverse to the first series, therefore maintaining relative registration of the layers to each other. The application of linear oriented transverse darts or ribs allows for relative flexibility and slippage of one layer relative to another layer in restricted areas where flexibility is required, while simultaneously preventing relative registration slippage in the rigid portions of the product application. For example, transverse oriented darts and/or ribs interlocking layers of a soleplate in a work boot allows flexibility in the front of the boot, provides rigid shank support under the arch, allows slippage between layers in the flexible portion of the soleplate, and prevents relative slippage between layers in the rigid shank portion of the soleplate. The transverse oriented ribs and/or darts prevent relative slippage in the linear directions of the ribs as well as preventing relative rotational slippage between the layers.

It is an objective of the subject invention to layer preferred embodiments in such a way as to deflect incidental impact away from the wearer. In much the same way that roofing shingles are layered so the rain runs off the roof rather than run between the layers, the preferred embodiment layers provide a measure of deflection from incidental impact force, minimizing the potential for the force to be directed toward the wearer.

It is an objective of the subject invention to provide product applications in composite construction that combines the rigid features of one material with the flexible features of another material. For example, a rigid Kevlar component can be embedded into a soleplate constructed from a flexible Kevlar material. The composite nature of the construction provides puncture resistance and/or shrapnel protection without sacrificing flexibility or rigid requirements of the combat boot.

It is an objective of the subject invention to provide product applications constructed from a relatively thin and flexible layer with attached and/or integral rigid structures spaced in such a way to allow flexibility of the relatively thin layer, acting similar to a hinge portion between juxtaposed rigid structures. The rigid structures provide a shape which meets the strength requirements of a specific application. The rigid structures can be integrally formed as part of the relatively thin hinge layer, or they can be separately manufactured structures that are applied to cooperate with the relatively thin hinge layer. For example, a metatarsal PPE component can be constructed from a relatively thin layer to provide flexibility of the metatarsal component conforming to the foot curvatures, while the relative rigid structures straddle the hinge areas and provide rigid support and protection. The rigid structures provide a mosaic of armor arranged straddle of hinge areas in the relatively thin layer. The combination of the relatively thick armor combined with the relatively thin hinge layer provides protection without sacrificing flexibility. Variations of this preferred embodiment are also enhanced with the incorporation of the layered deflection feature disclosed above.

It is a further objective of the subject invention to provide a light-duty metatarsal component and/or light-duty safety toe and/or other light-duty components for sports shoes such as football, soccer, rugby, hockey, and other contact activities where incidental contact injuries to the foot are commonplace. Such injuries can be minimized and/or avoided by incorporating light-duty components of the subject invention that provide rigid protection for the foot, while at the same time providing flexibility for comfort and agility. Traditional metatarsal devices are externally attached to the shoe; this construction method is particularly disadvantageous for a sports shoe due to the potential for being caught while wearing and causing a tripping hazard. The preferred embodiment overcomes this shortcoming by being designed to be embedded into the tongue of the shoe.

It is a further objective of the subject invention to provide a wide variety of applications of light duty to heavy duty PPE components for various industrial, sports, commercial, manufacturing, skilled trades, military, first responder, and/or medical applications of incidental contact devices for arm, chest, head, back, leg, hand, finger, elbow, knee, neck, etc. Rigid protection combined with flexibility for agility is paramount and accomplished with various applications of the subject invention.

It is an objective of the subject invention to provide a toe cap with a structural member that acts in compression when subjected to lateral side crush forces, but acts in tension when subjected to vertical crush forces.

It is a further objective of the subject invention to provide a toe cap with a structural member that provides improved strength performance against vertical crush forces, such that the toe cap design can be fine-tuned and made with thinner walls that will still meet and comply with technical performance standards, the resulting toe cap not being as bulbous or bulky as prior art toe caps with the same crush rating.

It is a further objective of the subject invention to provide a toe cap with a structural member that can be removed and/or is a separate component to the toe cap.

It is a further objective of the subject invention to provide a toe cap with a structural member that can be manufactured from a different material than the toe cap.

It is a further objective of the subject invention to provide a toe cap with a structural member that is integral with the toe cap.

It is a further objective of the subject invention to provide a toe cap with a structural member that is solid across the entire under surface of the toe cap.

It is a further objective of the subject invention to provide a toe cap with a structural member that is a brace or columnar member.

It is a further objective of the subject invention to provide a toe cap enhanced with downward extending tabs that cooperate with a soleplate in such a way that vertical and/or lateral crushing forces acting upon the toe cap are transmitted to the soleplate and supported by a portion of the soleplate such that the soleplate acts as a structural member for tension and compression for the toe cap.

It is a further objective of the subject invention to provide a toe cap with a structural member that has a slight convex bow away from the bottom of the foot, so that when the member is placed in compression, it will tend to continue to bow further away from the foot and not arch up toward the foot. Correspondingly, when the member is placed in tension, it will tend to straighten out.

It is a further objective of the subject invention to provide a toe cap with a structural member that has a non-planar surface on the underside of the flange portions, which exhibits an included obtuse angle "$\phi$" expressed by the relationship: $160° < \phi < 180°$.

It is a further objective of the subject invention to provide a toe cap with a structural member that has rib-like cross sectional shapes so that minimized wall thicknesses can be utilized.

It is a further objective of the subject invention to provide a toe cap with a structural member that is independent but cooperates with the toe cap to positively lock and/or restrict the open ends of the toe cap from moving outward or inward relative to each other.

It is a further objective of the subject invention to provide a toe cap with a structural member that said independent member cooperates with the toe cap via any one of numerous interlocking tabs. Said tabs may originate on the ends of the toe cap, on the ends of the structural member, or both. The cooperation between the structural member and the toe cap may be via a separate component item, designed to facilitate cooperation between the toe cap and the structural member, such as a lace, binding, staple, hinge, mechanical interlock, etc.

It is a further objective of the subject invention to provide a toe cap with a structural member that is positioned such that it absorbs and/or dissipates vertical crush forces in a way that prevents the walls of the toe cap from having to absorb the brunt and totality of the crushing force. This feature is accomplished via the individual contribution performance of the convex structural member.

It is a further objective of the subject invention to provide a toe cap with a structural member in which said included obtuse angle "$\phi$" of the non-planar surface on the underside of the flange portions tends to increase in value approaching 180° when subjected to vertical crush forces, but will decrease in value away from 180° when subjected to vertical crush forces.

It is a further objective of the subject invention to provide a toe cap with a structural member that the convex surface be a relative arc form, which may or may not be a true arc when the toe cap is at rest, and void of any forces acting upon it. Said relative convex surface may be deliberately in the shape of a parabola, an ellipse, an arc, or a series of straight flat surfaces transitioning straight section to straight section via small radiuses. In addition, the relative convex shape can be non-symmetrical in multiple planes and/or sections such that the relative convex shape side-to-side across the foot (transverse to the center line of the foot) might be different to the relative cross-sectional shape oriented on the center line of the foot.

It is a further objective of the subject invention to minimize and/or eliminate shoe construction components directly under the toe cap, such as is often referred to as "red board", which will save money, component inventory, assembly cost, and assembly time.

It is a further objective of the subject invention to provide a toe cap with a structural member with a flange portion oriented non-planar relative to the vertical wall of the toe cap such that an obtuse angle "β" is formed between the outside wall and the underside flange portion. Said angle "β" can be expressed by the relationship: $90° < \beta < 100°$.

It is a further objective of the subject invention to provide a toe cap with a structural member in which said included obtuse angle "β" of the non-planar surface on the underside of the flange portions tends to decrease in value approaching 90° when subjected to vertical crush forces, but will increase in value away from 90° when subjected to vertical crush forces.

It is a further objective of the subject invention to provide a toe cap with a structural member in which said included obtuse angles "ϕ" and "β" respond oppositely with respect to each other in response to vertical and/or lateral crush forces.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 1B:
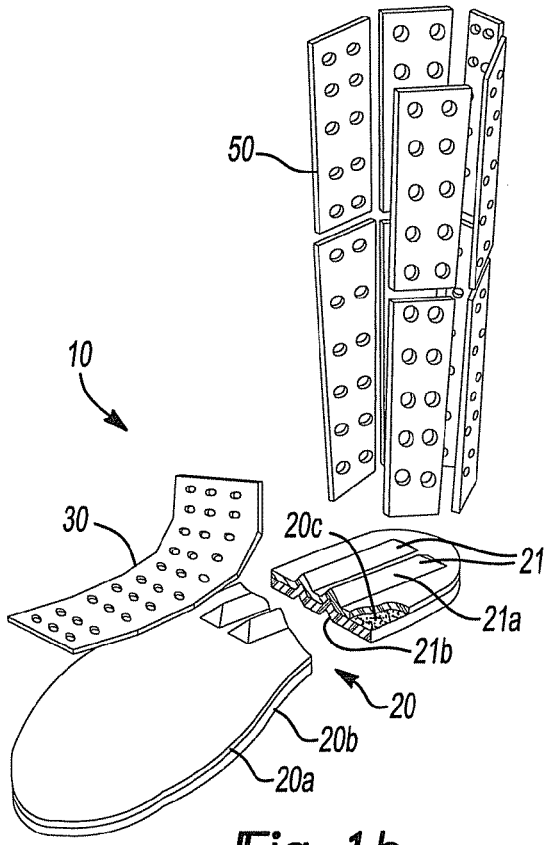
Figure 1C:
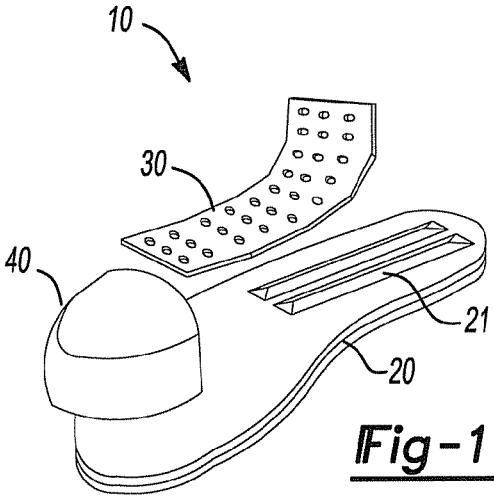
Figure 1D:
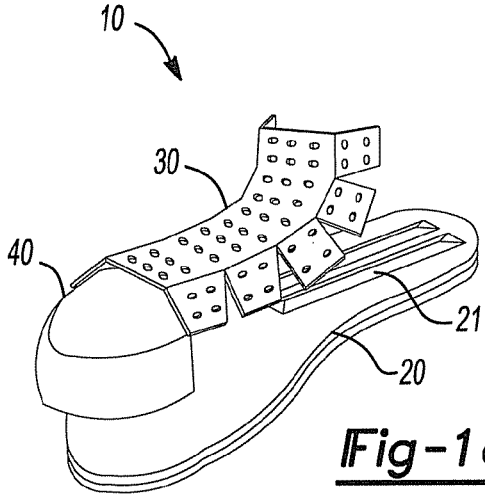
Figure 2A:
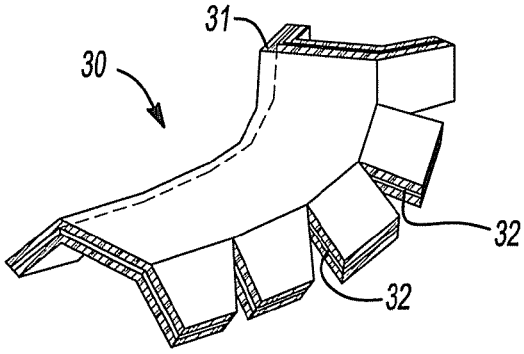
Figure 2B:
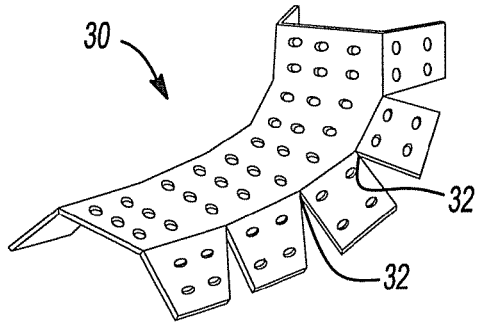
Figure 2C:
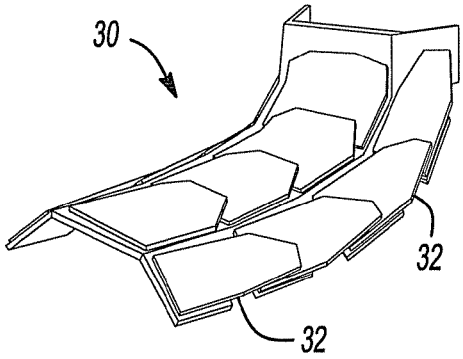
Figure 2D:
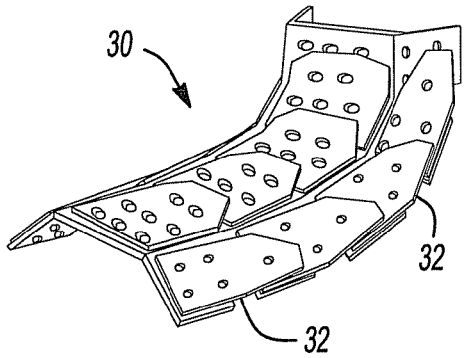
Figure 2E:
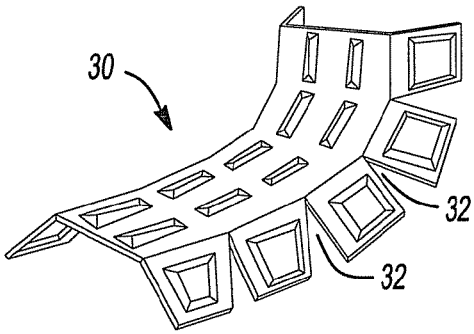
Figure 2F:
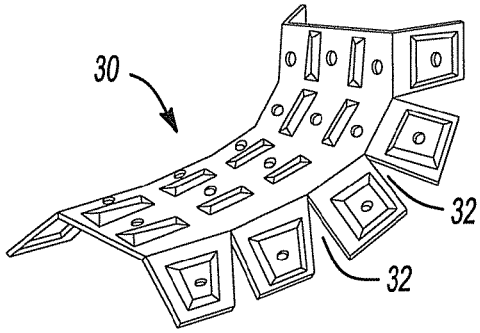
Figure 2G:
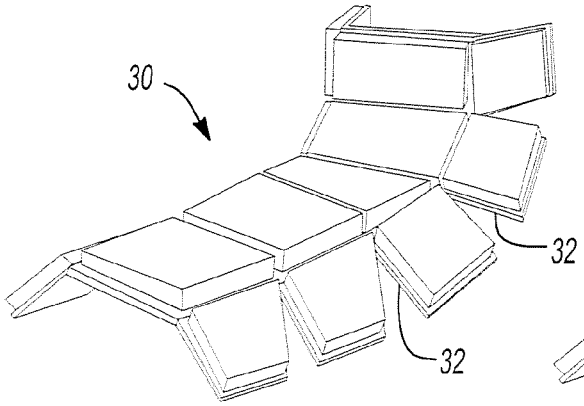
Figure 2H:
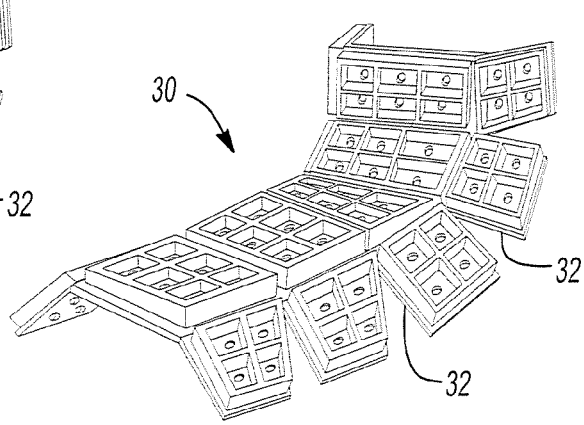
Figure 3A:
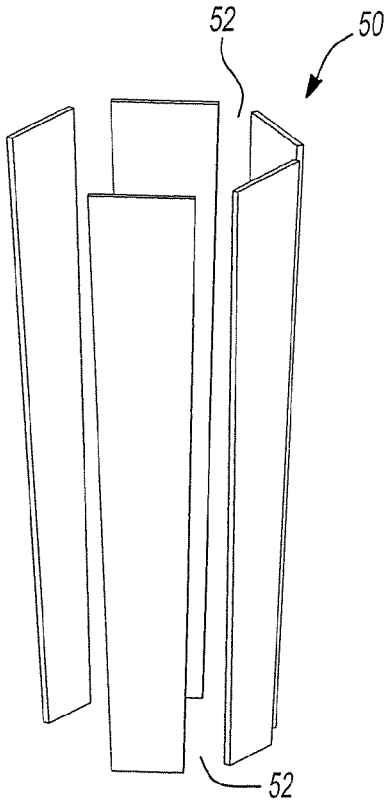
Figure 3B:
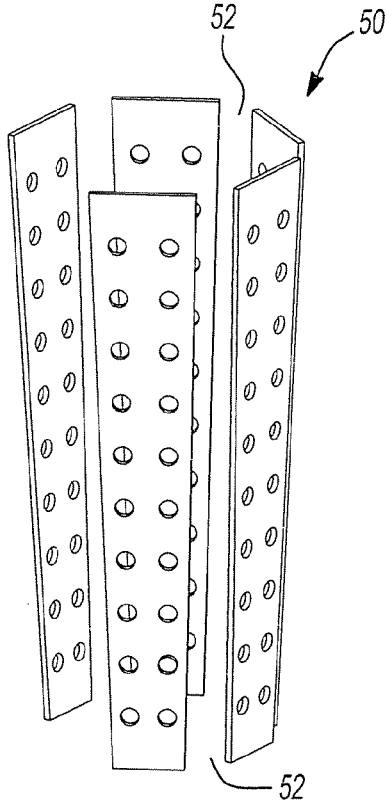
Figure 3C:
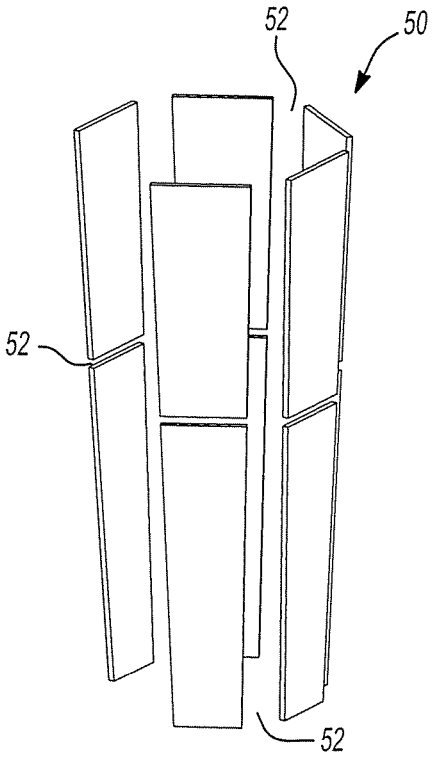
Figure 3D:
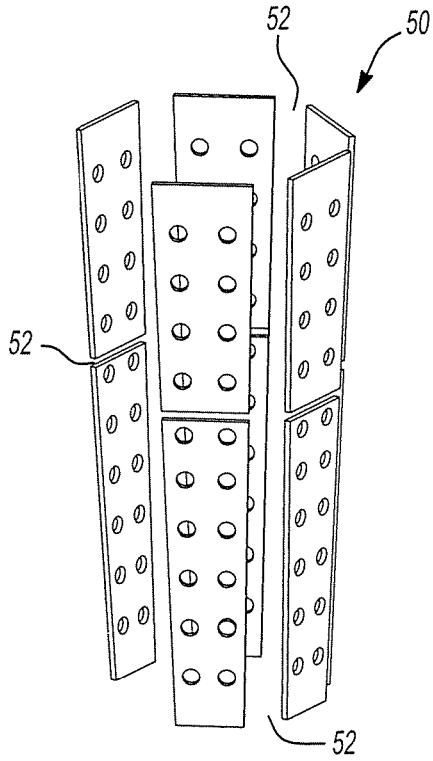
Figure 3E:
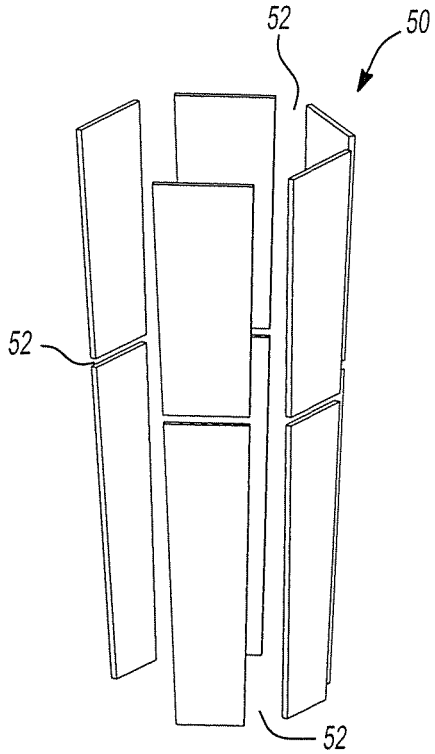
Figure 3F:
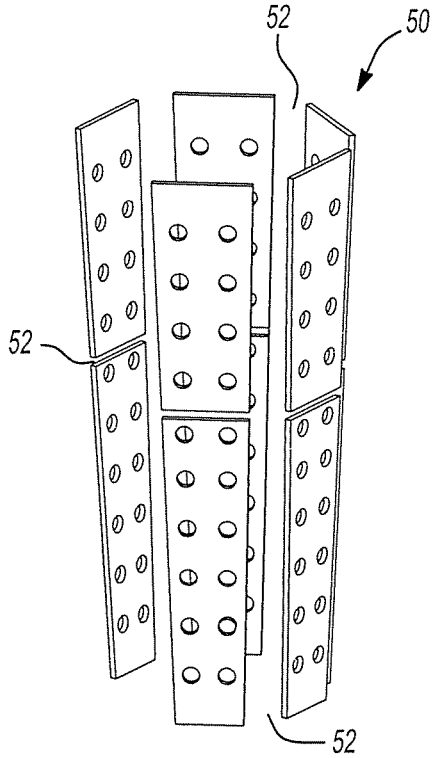
Figure 3G:
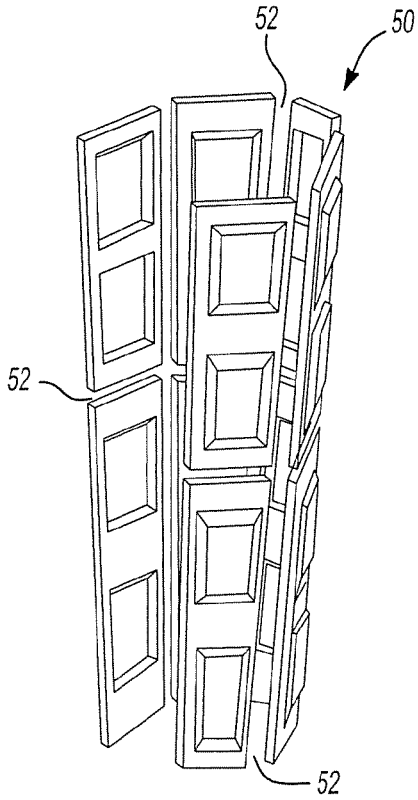
Figure 3H:
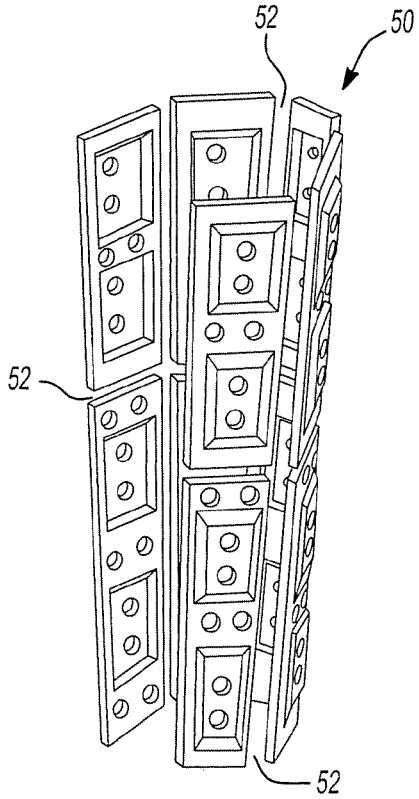
Figure 4A:
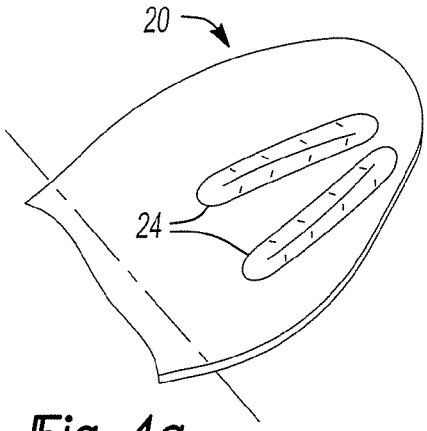
Figure 4B:
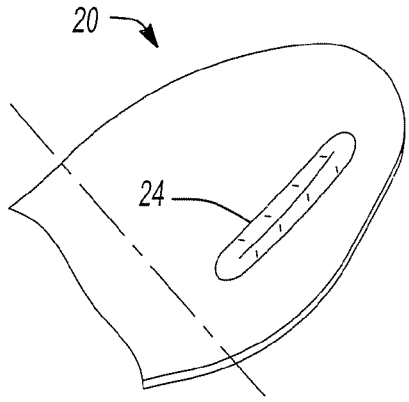
Figure 4C:
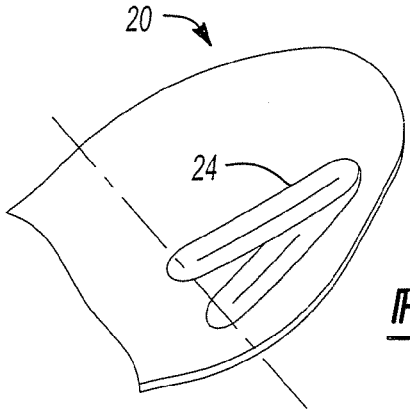
Figure 5A:
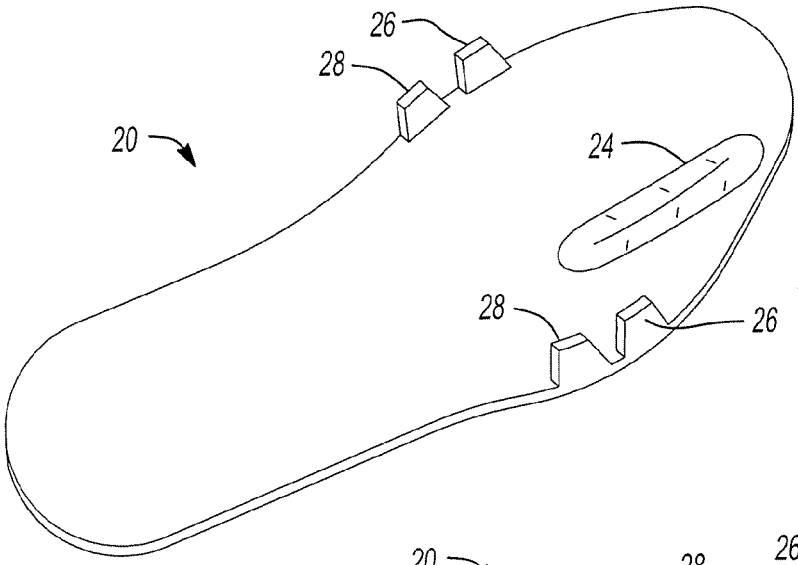
Figure 5B:
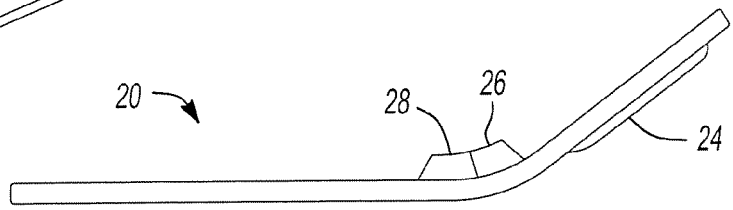
Figure 5C:
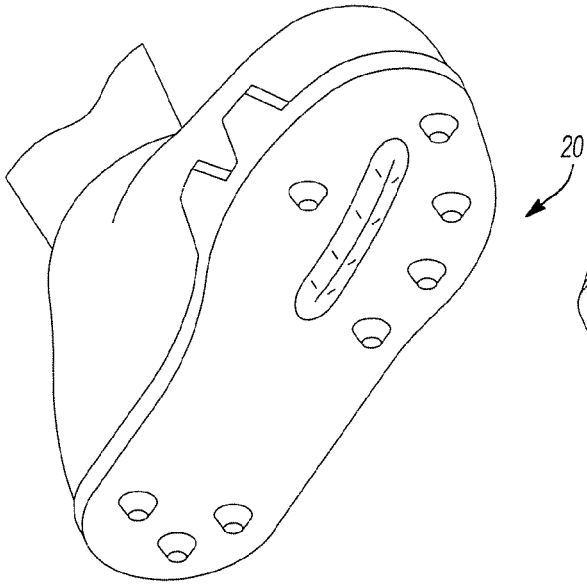

FIG. 1*a* is a partial cross sectional perspective view of the components comprising a boot guard for combat or heavy industrial environments;

FIG. 1*b* is a partial cross sectional perspective view of the components comprising a boot guard for outdoor boots or snake-bite boots;

FIG. 1*c* is a perspective view of the components comprising a boot guard for a typical work boot or tennis shoe style work boot;

FIG. 1*d* is a perspective view of the components comprising a boot guard for a typical shoe-style work boot for use in industrial applications;

FIG. 2*a* is a perspective isolated view of a first embodiment of the metatarsal component comprising a boot guard;

FIG. 2*b* is a perspective isolated view of a second embodiment of the metatarsal component comprising a boot guard;

FIG. 2*c* is a perspective isolated view of a further embodiment of the metatarsal component comprising a boot guard;

FIG. 2*d* is a perspective isolated view of a further embodiment of the metatarsal component comprising a boot guard;

FIG. 2*e* is a perspective isolated view of a further embodiment of the metatarsal component comprising a boot guard;

FIG. 2*f* is a perspective isolated view of a further embodiment of the metatarsal component comprising a boot guard;

FIG. 2*g* is a perspective isolated view of a further embodiment of the metatarsal component comprising a boot guard;

FIG. 2*h* is a perspective isolated view of a further embodiment of the metatarsal component comprising a boot guard;

FIG. 3*a* is a perspective isolated view of a first embodiment of the tibia-fibula component comprising a boot guard;

FIG. 3*b* is a perspective isolated view of a further embodiment of the tibia-fibula component comprising a boot guard;

FIG. 3*c* is a perspective isolated view of a further embodiment of the tibia-fibula component comprising a boot guard;

FIG. 3*d* is a perspective isolated view of a further embodiment of the tibia-fibula component comprising a boot guard;

FIG. 3*e* is a perspective isolated view of a further embodiment of the tibia-fibula component comprising a boot guard;

FIG. 3*f* is a perspective isolated view of a further embodiment of the tibia-fibula component comprising a boot guard;

FIG. 3*g* is a perspective isolated view of a further embodiment of the tibia-fibula component comprising a boot guard;

FIG. 3*h* is a perspective isolated view of a further embodiment of the tibia-fibula component comprising a boot guard;

FIG. 4*a* is a partial perspective view of a first embodiment of the soleplate of the present invention;

FIG. 4*b* is a partial perspective view of a further embodiment of the soleplate of the present invention;

FIG. 4*c* is a partial perspective view of a further embodiment of the soleplate of the present invention;

FIG. 5*a* is a perspective view of a further embodiment of the soleplate of the present invention;

FIG. 5*b* a is a partial perspective view of soleplate shown in FIG. 5*a* in the deflected orientation;

FIG. 5*c* is a perspective underside view of the soleplate embodiment shown in FIG. 5*a;*

Figure 6:
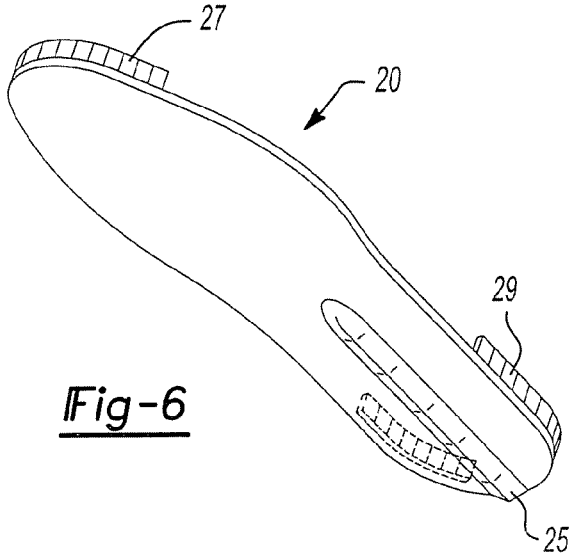
Figure 7A:
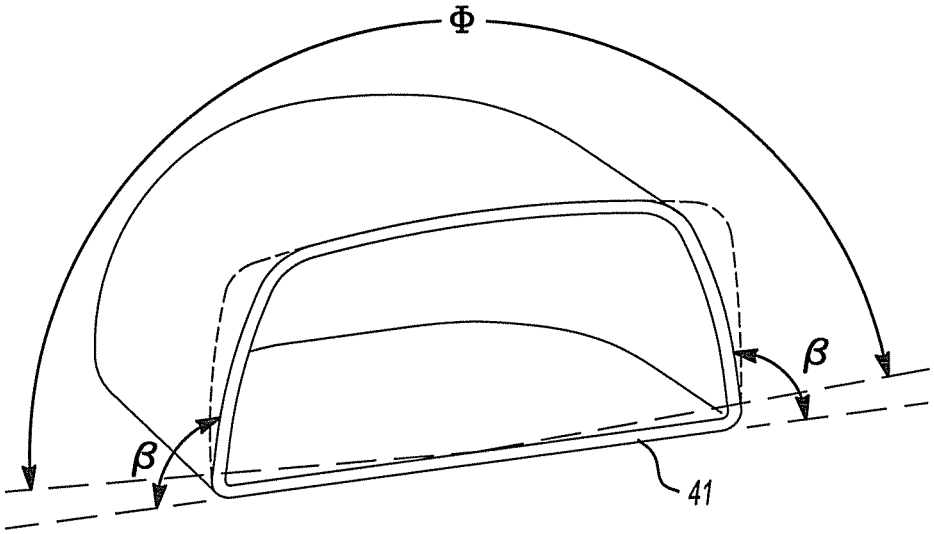
Figure 7B:
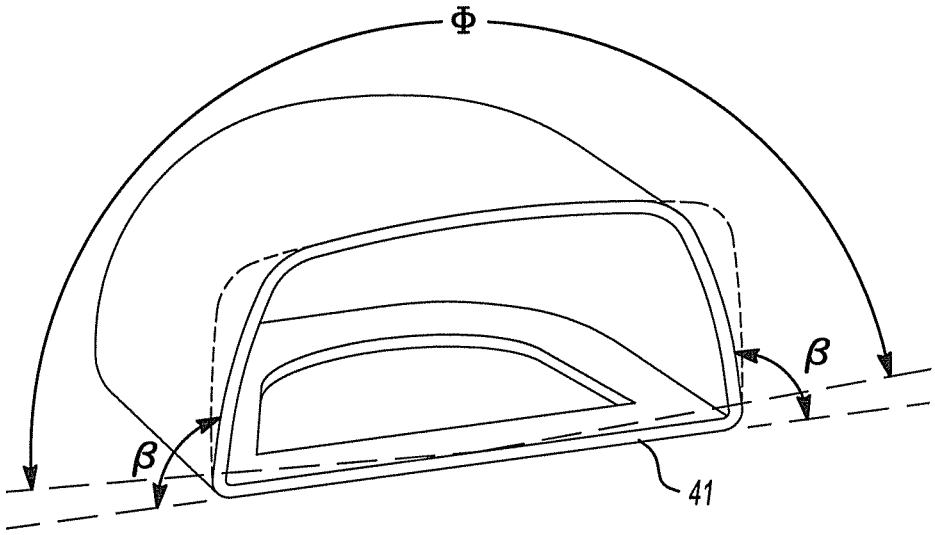
Figure 7C:
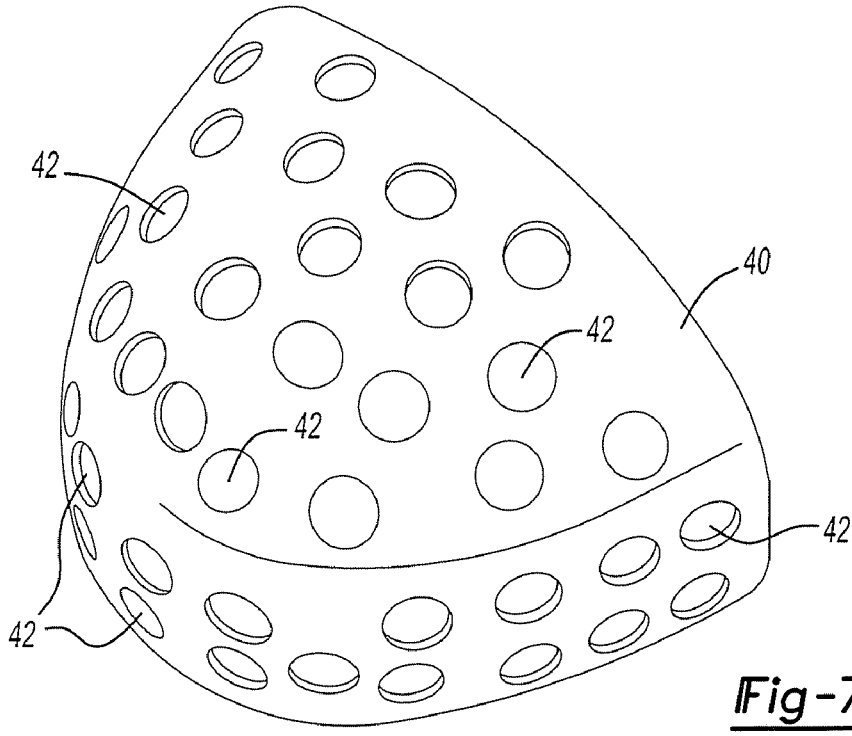
Figure 7D:
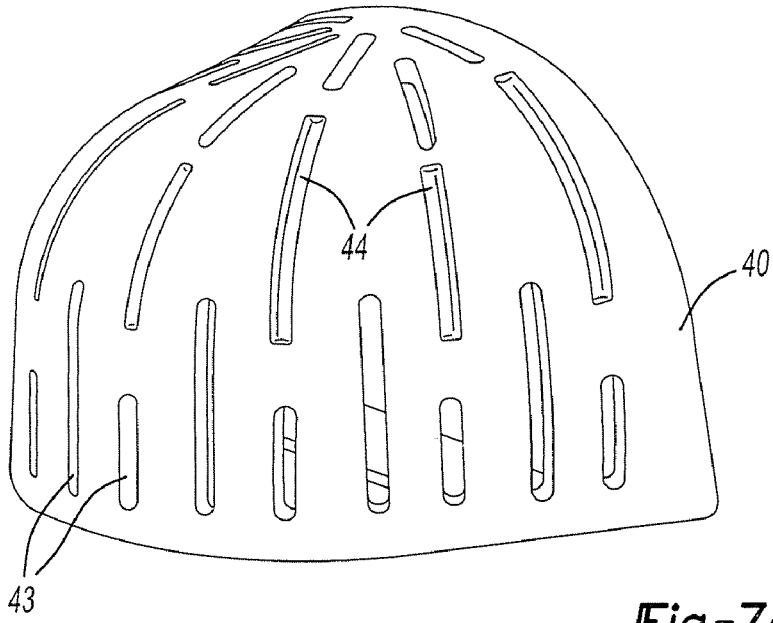

FIG. 6 is a perspective view of a further embodiment of the soleplate of the present invention;

FIG. 7*a* is a perspective view of a further embodiment of the present invention comprising a closed-toe cap;

FIG. 7*b* is a perspective view of a further embodiment of the present invention comprising an open-bottom toe cap;

FIG. 7*c* is a perspective view of a further embodiment of the present invention comprising a toe cap implementing a plurality of weight minimizing/ventilation holes; and FIG. 7*d* is a perspective view of an open-bottom toe cap implementing a plurality of weight minimizing/ventilation slots and strengthening darts.

DETAILED DESCRIPTION

The following description is merely exemplary in nature and is not intended to limit the present disclosure, application, or uses. It should be understood that throughout the drawings, corresponding reference numerals indicate like or corresponding parts and features.

The subject invention has many preferred embodiments using a wide variety of construction materials, such as metal, plastic, polymers, composites, fiberglass, Kevlar type materials, and others familiar to those skilled in the art. Each material brings with it manufacturing techniques synonymous with that particular material and/or combination of materials.

For instance, metal components can be cast, forged, machined, stamped, etc. Plastic, polycarbonates, and polymers can be formed from sheets, molded, extruded, heat shaped, vacuum formed, blow molded, etc. Kevlar type materials and other exotic materials require processes that are consistent with that material to fabricate PPE components using the features of the subject invention.

Therefore, typical construction methods are used according to the selected construction materials employed for the application. Those skilled in the art of construction materials and manufacturing processes will appreciate that the subject invention can be manufactured using any one of many standard practices and techniques.

Referring now to the drawings, in particular FIGS. 1*a*-1*d*, the preferred embodiments of the subject invention are shown comprising a boot/shoe guard 10, having a soleplate 20, a metatarsal component 30, a toe cap 40, and a tibia-fibula component 50. These components can be implemented alone or in combination within a shoe or boot, providing for a varied level of protection depending on the application.

The soleplate 20 provides a puncture-resistant layer on the bottom of the footwear, which can comprise a single layer 20*a* or multiple layers 20*a*, 20*b* secured together by an adhesive 20*c*. In the event that multiple layers 20*a*, 20*b* are embodied, the adhesive 20*c* utilized is flexible, allowing portions of adjacent layers 20*a*, 20*b* to slip relative to each other during flexing while preventing other portions from slipping by providing interlocking ribs or darts 21. Said darts 21 or rib structures provide interlocking features 21*a*, 21*b* as well as rigid shank support in a specified portion of the soleplate 20. Other preferred embodiments employ adjacent layers 20*a*, 20*b* with similar flexible features disclosed for the previous embodiment, but do not provide interlocking ribs 21. Instead, this embodiment provides one layer with ribs or darts 24 and uses a fastening means, such as adhesive 20*c* film, gel, or other fastening means, to secure the adjacent layers 20*a*, 20*b* in the rigid shank support portion. The rib or dart 21 forms a triangle or arc-type cross section with the cooperating plate. The secure connection between the adjacent layers 20*a*, 20*b* provides a strong structural cross-sectional geometry for the shank support portion.

In addition to PPE, variations of the above embodiment have potential applications for improved manufacture of composite-layered skateboards, surfboards, diving boards, construction and/or structural components, aircraft wing components, stadium seats, modular furniture, and many other applications.

Referring back now to FIGS. 2*a*-2*h*, another element of the present invention is shown in several embodiments showing a metatarsal PPE component 30 that provides rigid incidental impact protection while at the same time providing some flexibility for agility and comfort. The preferred embodiment incorporates slots, structural breaks, or hinge points that allow flexibility in designated locations and directions. The component embodiment has a light-duty version that can be inserted into a tongue 31 of the shoe, hiding its presence from view, and yet providing a measure of metatarsal protection. A typical heavy-duty version of the embodiment attaches externally similar to traditional metatarsal devices, but provides the feature of flexibility, providing extra comfort and agility to the wearer. The metatarsal components can comprise various elements, such as plural overlapping plates, single or multiple layer plates, ventilation holes, or pre-formed crush ribs.

Referring now to FIGS. 3*a*-3*h*, a further element of the present invention is shown in several embodiments showing structural tibia-fibula PPF components 50 that can be incorporated into, onto, and/or slipped inside of a boot, such as a combat boot, jump boot, first responder boot, etc., providing protection to the Tib-Fib portions of lower leg. These components provide flexibility from specifically oriented and/or located hinges 52 and/or thick-thin portions that form a mosaic of rigid protection structures interwoven with flexible hinge structures. Preferred embodiments of this application provide protection for combat boots from projectiles initiated from improvised explosive devices (IED). The protection is designed to minimize certain lower leg injuries that might have otherwise resulted in the loss of limbs.

Referring now to FIGS. 4*a*-4*c*, further embodiments of the soleplate are shown. In traditional sports and athletic shoes, the evolution of the cleat from a traditional 7-cleat shoe containing a steel plate in the sole to a more flexible soccer-style shoe to artificial turf shoes have increased speed at the price of stability. The absence of a stiff soleplate, especially under the metatarsal phalangeal (MTP) joints, places an athlete at greater risk of injury. This often comes from rolling of the ball of the foot, as well as jamming of the toes during athletic maneuvers. As shown in FIGS. 4*a*-4*c*, one or more darts or ribs 24 are formed within the soleplate 20 either alone or in combination proximal the big toe to improve rigidity of the soleplate 20. This embodiment of soleplate can be built into the construction of the shoe and/or applied to a "loose insert" insole application.

FIGS. 5*a* through 5*c* illustrate a further embodiment of the soleplate, wherein structurally integrated deflection limiters 26 and 28 are formed with the soleplate 20 on either side of the soleplate, proximal the ball of the foot. These prevent the soleplate 20 from over deflection during athletic maneuvers, causing serious injuries. Foam, padding, or fabric is positioned between the limiters 26 and 28 to prevent a pinch point. This embodiment is intended to be built into the construction of the shoe.

Referring now to FIG. 6, a further embodiment of the soleplate of the present invention is shown. In this embodiment, a lip or flange portion 27 is on the toe end of the soleplate and at the heel end 29 of the soleplate. The lip or flanges 27, 29 are easily stamped as part of the formation of the soleplate, along with the integral shank darts 25. The presence of the darts 25 provides some resistance to shift in the longitudinal axis while providing increased support and stability.

A further embodiment of the subject invention provides a safety toe cap 40 that incorporates a curved-in flange portion 41 around the base of the safety toe that is deliberately slanted with an angled surface that is oriented at a slightly beveled angle relative to the surface of the soleplate as shown in FIGS. 7*a* and 7*b*. The curved-in flange portion which exhibits an included obtuse angle "ϕ" is expressed by the relationship:

$$160° < \phi < 180°$$

This provides a toe cap 40 with a structural member that is positioned such that it absorbs and/or dissipates vertical crush forces in a way that prevents the walls of the toe cap from having to absorb the brunt and totality of the crushing force.

The toe cap with said included obtuse angle "ϕ" of the non-planar surface on the underside of the flange portions tends to increase in value approaching 180° when subjected to vertical crush forces, but will decrease in value away from 180° when subjected to horizontal crush forces.

The convex surface of the top of the toe cap 40 may be of relative arc form and may or may not be a true arc when the toe cap is at rest and void of any forces acting upon it. Said relative convex surface may be deliberately in the shape of a parabola or an ellipse, an arc, or a series of straight flat surfaces transitioning straight section to straight section via small radiuses. In addition, the relative convex shape can be non-symmetrical in multiple planes and/or sections such that the relative convex shape side-to-side across the foot (transverse to the center line of the foot) might be different to the relative cross-sectional shape oriented on the center line of the foot.

The toe cap is designed to be utilized within shoes without the use of the commonly necessary 'red board' often utilized for structural support due to the base of the toe cap joining the outer walls under the toes.

The toe cap 40 further defines the wall portion in relation to the flange portion 41 oriented relative to the vertical wall of the toe cap such that an obtuse angle "β" is formed between the outside wall and the underside flange portion. Said angle "β" can be expressed by the relationship:

$$90° < \beta < 100°$$

This provides the toe cap with a structural member in which said included obtuse angle "β" of the non-planar surface on the underside of the flange portions tends to decrease in value approaching 90° when subjected to vertical crush forces, but will increase in value away from 90° when subjected to horizontal crush forces. Obtuse angles "ϕ" and "β" respond oppositely with respect to each other in response to vertical and/or lateral crush forces.

This slightly beveled angle forms an interior wall angle greater than 90° relative to the inside wall of the safety toe. In the event of incidental impact, the beveled flange portion is in a position to flex in such a way that the greater-than-90° angle is compressed toward the 90° point. This compression results in the absorption of the initial impact force, reducing the impact force. The rest of the structure dissipates the remainder of the impact force away from the foot.

Referring now to FIGS. 7*c* and 7*d*, a further embodiment of the toe cap 40 is illustrated. In these illustrations, the toe cap 40 has either a plurality of holes 42 or slots 43, either molded into the cap structure or machined into the cap after manufacturing. These apertures reduce the overall weight of the toe cap 40 without significantly sacrificing the integrity and protection the toe cap provides. In addition to reducing the overall weight of the toe cap 40 by up to 10%, these holes 42 and slots 43 further provide ventilation within the toe cap by allowing air to passively circulate in and out of the cap.

Further shown in FIG. 7*d*, an additional feature of the toe cap 40 may include a series of strengthening darts 44 extending inward in the cap, providing additional integrity to the toe cap 40. These features may be implemented on either the closed-toe cap embodiment or the open-bottom toe cap having the flange portion 41 shown in FIG. 7*b*, depending upon the desired application.

The preferred embodiments of the subject invention may employ a wide variety of construction materials, such as metal, plastic, polymers, composites, fiberglass, Kevlar type materials, and others familiar to those skilled in the art. Each material brings with it manufacturing techniques synonymous with that particular material and/or combination of materials.

For instance, metal components can be cast, forged, machined, stamped, etc. Plastic, polycarbonates, and polymers can be formed from sheets, molded, extruded, heat shaped, vacuum formed, blow molded, etc. Kevlar type materials and other exotic materials require processes that are consistent with that material to fabricate PPE components using the features of the subject invention.

Alternative methods to apply resilient adhesives using epoxy, films, glue, sealants, etc, are plentiful, and those skilled in the art will readily appreciate the spirit of the subject invention and how numerous construction techniques can be drawn upon to facilitate embodiment applications of the subject invention.

What is claimed is:

1. Protective components utilized in conjunction with footwear, said protective components comprising at least the following:

a soleplate, said soleplate comprising at least one layer positioned in a base of a footwear member;

a metatarsal component, said metatarsal component including at least one flexible plate, positioned in a top of said footwear member, proximal the metatarsals of a user wearing said footwear member;

a toe cap, said toe cap including a rigid, deformable element positioned in the front of said footwear member; and a tibia-fibula component, said tibia-fibula component including multiple rigid vertical plates separated by flexible hinges positioned within the footwear member proximal the tibia-fibula of the user, wherein said protective components are manufactured from at least one of the following materials: plastic, polycarbonates, plastic polymers, a metal, metals, composites, fiberglass and Kevlar, and said protective components are implemented within said footwear member during the manufacturing and assembly of said footwear member.

2. The protective components utilized in conjunction with the footwear member of claim 1, wherein said footwear member includes at least one of the following: work boots, athletic shoes, combat boots, outdoor boots, and casual shoes.

3. The protective components utilized in conjunction with the footwear member of claim 2, wherein said soleplate comprises at least two layers, said at least two layers are attached to each other utilizing a flexible adhesive, allowing adjacent layers to slip relative to one another.

4. The protective components utilized in conjunction with the footwear member of claim 3, wherein each of said at least two layers comprising said soleplate further comprise at least one interlocking dart, preventing one portion of said at least two layers from slipping relative to one another.

5. The protective components utilized in conjunction with the footwear member of claim 2, wherein said metatarsal component incorporates at least one of the following: slots, structural breaks, or hinge points, allowing flexibility in said metatarsal component.

6. The protective components utilized in conjunction with the footwear member of claim 2, wherein said metatarsal component can be inserted into the tongue of said footwear member.

7. The protective components utilized in conjunction with the footwear member of claim 2, wherein said metatarsal component comprises at least one of the following elements: plural overlapping plates, single plates, multiple layer plates, ventilation holes, or pre-formed crush ribs.

8. The protective components utilized in conjunction with the footwear member of claim 2, wherein said tibia-fibula component incorporates at least one of the following: slots, structural breaks, or hinges, allowing flexibility in said metatarsal component.

9. The protective components utilized in conjunction with the footwear member of claim 2, wherein said tibia-fibula component can be inserted into the tongue of said footwear.

10. The protective components utilized in conjunction with the footwear member of claim 2, wherein said tibia-fibula component comprises at least one of the following elements: plural overlapping plates, single plates, multiple layer plates, ventilation holes, pre-formed crush ribs, plates of varying thickness, or a mosaic of rigid protection structures interwoven with flexible hinge structures.

11. The protective components utilized in conjunction with the footwear member of claim 2, wherein said toe cap comprises a curved-in flange portion around the base of said toe cap, said curved-in flange portion is slanted with an angled surface oriented at a beveled angle relative to a bottom surface of said soleplate, said toe cap further including a convex surface of the top of said toe cap, said convex surface exhibiting at least one of the following shapes: parabola, ellipse, arc, or series of straight flat surfaces transitioning straight section to straight section via small radiuses.

12. The protective components utilized in conjunction with the footwear member of claim 11, wherein said curved-in flange portion of said toe cap exhibits an included obtuse angle "ϕ" expressed by the relationship: $160° < \phi < 180°$.

13. The protective components utilized in conjunction with the footwear member of claim 2, wherein said toe cap comprises a wall portion in relation to said curved-in flange portion such that an obtuse angle "β" is formed between said wall and the underside of said curved-in flange portion, said angle "β" can be expressed by the relationship: $90° < \beta < 100°$, said obtuse angle "β" tends to decrease in value approaching 90° when subjected to vertical crush forces, and said obtuse angle "β" tends to increase in value away from 90° when subjected to horizontal crush forces.

14. Protective components utilized in conjunction with footwear, said protective components comprising at least the following:

a soleplate, said soleplate including two layers positioned in the base of a footwear member, one of said layers having a dart of a triangle shaped cross section extending into the other of said layers, said dart preventing said two layers from slipping relative to one another;

a metatarsal component, said metatarsal component including at least one flexible plate, positioned in a top of said footwear, proximal the metatarsals of a user wearing said footwear member;

a toe cap; said toe cap including a rigid, deformable element positioned in the front of said footwear member and a curved-in flange portion around a base of said toe cap, said curved-in flange portion slanted with an angled surface oriented at a beveled angle; and a tibia-fibula component, said tibia-fibula component including at least one vertical plate positioned within the footwear member proximal the tibia-fibula of the user, wherein said protective components are manufactured from at least one of the following materials: plastic, polycarbonates, plastic polymers, metals, composites, fiberglass, and Kevlar, said protective components include elements which can be worn in conjunction with the footwear member created as a pre-manufactured footwear member.

15. The protective components utilized in conjunction with the footwear member of claim 14, wherein said footwear includes at least one of the following: work boots, athletic shoes, combat boots, outdoor boots, and casual shoes.

16. The protective components utilized in conjunction with the footwear member of claim 15, wherein said metatarsal component incorporates at least one of the following: slots, structural breaks, or hinge points, allowing flexibility in said metatarsal component.

17. The protective components utilized in conjunction with the footwear member of claim 15, wherein said metatarsal component can be inserted into the tongue of said footwear member.

18. The protective components utilized in conjunction with the footwear member of claim 15, wherein said metatarsal component comprises at least one of the following elements: plural overlapping plates, single plates, multiple layer plates, ventilation holes, or pre-formed crush ribs.

19. The protective components utilized in conjunction with the footwear member of claim 15, wherein said tibia-fibula component incorporates at least one of the following: slots, structural breaks, or hinges, allowing flexibility in said metatarsal component.

20. The protective components utilized in conjunction with the footwear member of claim 15, wherein said tibia-fibula component can be inserted into the tongue of said footwear.

21. The protective components utilized in conjunction with the footwear member of claim 15, wherein said tibia-fibula component comprises at least one of the following elements: plural overlapping plates, single plates, multiple layer plates, ventilation holes, pre-formed crush ribs, plates of varying thickness, or a mosaic of rigid protection structures interwoven with flexible hinge structures.

22. The protective components utilized in conjunction with the footwear member of claim 15, said toe cap further comprising a convex surface of the top of said toe cap, said convex surface exhibiting at least one of the following shapes: parabola, ellipse, arc, or series of straight flat surfaces transitioning straight section to straight section via small radiuses.

23. The protective components utilized in conjunction with the footwear member of claim 22, wherein said curved-in flange portion of said toe cap exhibits an included obtuse angle "ϕ" expressed by the relationship: $160° < \phi < 180°$.

24. The protective components utilized in conjunction with the footwear member of claim 15, wherein said toe cap comprises a wall portion in relation to said curved-in flange portion such that an obtuse angle "β" is formed between said wall and the underside of said curved-in flange portion, said angle "β" can be expressed by the relationship: $90° < \beta < 100°$, said obtuse angle "β" tends to decrease in value approaching 90° when subjected to vertical crush forces, and said obtuse angle "β" tends to increase in value away from 90° when subjected to horizontal crush forces.

25. The protective components utilized in conjunction with the footwear member of claim 14, wherein said at least two layers are attached to each other utilizing a flexible adhesive allowing said at least two layers to slip relative to one another except proximal to said dart.

* * * * *